US006004091A

United States Patent [19]

Roth

[11] Patent Number: 6,004,091

[45] Date of Patent: Dec. 21, 1999

[54] APPARATUS FOR CONVEYING ITEMS TO A SELECTED RECEIVING STATION

[76] Inventor: Hans U. Roth, Quellenstrasse 19, CH-9214 Kradolf, Switzerland

[21] Appl. No.: 09/010,263

[22] Filed: Jan. 21, 1998

[51] Int. Cl.[6] ..... E04H 6/42

[52] U.S. Cl. ..... 414/263; 414/253; 414/807

[58] Field of Search ..... 414/331, 263, 414/268, 269, 278, 285, 266, 253, 255, 256, 807, 331.01–331.05; 52/174, 175, 176

[56] References Cited

U.S. PATENT DOCUMENTS

| | | | |
|---|---|---|---|
| 1,797,325 | 3/1931 | Chaudoir | 414/263 |
| 3,055,517 | 9/1962 | Kirkland | 414/263 |
| 4,265,581 | 5/1981 | Ives et al. | 414/263 |
| 5,024,571 | 6/1991 | Shahar et al. | 414/263 |
| 5,286,156 | 2/1994 | Ikenouchi et al. | 414/256 |
| 5,469,676 | 11/1995 | Colsman | 52/174 |
| 5,478,182 | 12/1995 | Hildebrand et al. | 414/261 |
| 5,674,040 | 10/1997 | Wagner | 414/263 |

FOREIGN PATENT DOCUMENTS 0 604 818 A2 7/1994 European Pat. Off. .

2 716 482 8/1995 France .

OTHER PUBLICATIONS

Sicher et al., "RONDO Vollautomatisches Parksystem der Zukunft", 4 pages, no date.

*Primary Examiner*—Christopher P. Ellis
*Assistant Examiner*—Isobel A. Parker
*Attorney, Agent, or Firm*—Pandiscio & Pandiscio

[57] ABSTRACT

An apparatus for conveying items to a selected receiving station comprises a round carousel rotatable about a center thereof to align a portion thereof with a selected azimuth, a platform disposed in the carousel, the platform being movable rotatably with the carousel and movable vertically in the carousel to a selected height, and a sled disposed on the platform and movable on the platform sidewise through a path concentric with the carousel to align the sled with a second selected azimuth, the sled being configured to receive thereon at least one of the items. The item is movable circularly by the carousel, vertically by the platform, and circularly by the sled, whereby to be conveyed to and from the receiving station disposed at the selected height and at the second azimuth.

36 Claims, 14 Drawing Sheets

APPARATUS FOR CONVEYING ITEMS TO A SELECTED RECEIVING STATION

FIELD OF THE INVENTION

This invention relates to a storage bin assembly wherein items are moved automatically from an entry point to a selected storage bay and vice-versa, and is directed more particularly to a vehicle automatic parking garage.

BACKGROUND OF THE INVENTION

Increasing vehicle traffic in the larger population centers, as well as the increasing need for space, have made it necessary to provide parking places for even more vehicles, while at the same time minimizing the space used. In this connection, above-ground and underground garages are already known, in which vehicles are positioned close to one another on a plurality of parking levels. In this kind of parking garage, it is usual for the vehicles to move under their own power along appropriate ramps and corridors to the individual parking locations.

This kind of parking is, however, subject to various disadvantages. The entry and exit passages require a substantial amount of additional space, so that with a given construction volume, fewer parking spaces can be provided. Further, the vehicle exhaust gases make it necessary to provide extensive ventilation systems which greatly increase the cost of the parking facility and, in addition, require even more space. Moreover, this kind of installation must be publicly accessible, which on the one hand can endanger the parked automobiles in the sense of being stolen or damaged, and on the other hand can endanger individuals.

For these reasons, various proposals have been made in the past for the construction of mechanized, automatic parking garages, in which the vehicles are left by their owners in an entrance, are loaded onto a lift platform by a special apparatus, are conveyed to the entry of one of a plurality of parking compartments with the help of the lift platform, and finally are deposited within the corresponding parking compartment. In this connection, a particularly simple construction involves a circular arrangement with outwardly lying parking compartments and a central lift apparatus.

In U.S. Pat. No. 5,478,182, there is a discussion of several different automatic parking garages. For the sake of convenience, this discussion is substantially repeated below.

In Swiss Patent specification CH-A5-649 340, there is disclosed an automatic parking garage having:

(a) a storage silo with a circular periphery, which storage silo encloses a cylindrical inner shaft and includes, on a plurality of stacked parking levels, a plurality of radially directed parking compartments open toward the inner shaft; and (b) a conveying apparatus located in the inner shaft for the transportation of vehicles between at least one entrance and the parking compartments, or between the parking compartments and at least one exit, the conveying apparatus including a plurality of vehicle-receiving transport surfaces which are movable in a vertical direction and can be rotated together in a horizontal direction about a central axis, such that they can be positioned through vertical movement at the level of one of the parking levels or at the level of the at least one entrance, or the at least one exit, and then, through rotation about the central axis, can be brought adjacent to one of the parking compartments in the corresponding parking level.

In the parking garage described immediately above, a plurality of parking compartments or single parking spaces are arranged in different parking levels radially about a cylindrical shaft. In the shaft is provided an elevator apparatus with a rotatable lift platform which defines two rotatable spaces for receiving vehicles. By vertical movement and/or rotation of the platform about a central axis, all parking compartments can be reached by the rotatable spaces.

The two rotatable spaces are provided parallel with one another at opposite sides of the central axis, and have their longitudinal axes displaced away from one another, so that their longitudinal axes are substantially out of alignment with the radial direction. The parking compartments of each parking level are correspondingly angled to each other, so that their longitudinal axes can be brought into alignment with the longitudinal axes of the rotatable spaces. The parking spaces of each level are divided into two equal halves, such that each of the halves can be directed only to one of the rotatable spaces, because of the different angulation.

On the one hand, because of the special arrangement of the parking compartments, the construction of the parking garage is relatively expensive. On the other hand, the deposit of the vehicles is relatively slow, because only two rotatable spaces are available, and only one rotatable space is available for half of the parking compartments of one level.

A further automatic parking garage is known from the German publication DE-A 1-38 31 463. In this parking garage, the parking compartments are arranged radially. For the distribution of the vehicles there is likewise provided a combined lift and rotating apparatus, which, however, provides only a single transport space. The loading and unloading of the transport lift is assisted by an accessory car on which is placed the vehicle to be parked. Since the transport lift can only accept one vehicle, this type of parking garage cannot perform a rapid in and out parking cycle. The use of accessory cars, moreover, makes special apparatus necessary for introducing the car into all parking compartments, requiring a considerable technical expenditure.

Special transfer apparatus for the transportation of vehicles between lift and parking compartment are furthermore known from publications WO91/18162 and EP-A1-0 395 601. In the first of these two publications, a transfer apparatus is proposed which is mechanically very expensive, and especially susceptible to breakdown, this transfer apparatus requiring several levels which are displaceable with respect to each other and have comb-like ends which, upon depositing the vehicle in the parking compartment, inter-engage with corresponding comb-like configurations in the bottom of the compartment.

In the second of these two publications, a transfer apparatus is disclosed which travels sideways with respect to the vehicle and utilizes one of the forward wheels to pull the vehicle into the lift and to push the vehicle into a parking compartment. Because of the external position of the transfer apparatus, additional room is required. Moreover, this transfer apparatus grips only one side of the vehicle, which leads to an unbalanced loading of the chassis.

In U.S. Pat. No. 5,478,182, there is disclosed an automatic parking garage in which the individual parking compartments on the parking levels and the lift mechanism are positioned in a precise radial direction. In the lift, several transport surfaces, preferably four, are provided for the vehicles. The individual parking compartments can be accessed by all transport surfaces in the same manner, since the construction has a high degree of symmetry, and all compartments are equivalent to each other. Finally, the connection between a transport surface and a parking compartment is particularly simple, because the facing edges are very closely spaced due to the radial configuration.

The transport surfaces can be moved in various ways. In accordance with a first preferred embodiment of the invention, the transport surfaces are provided on a common transport platform, and are displaced together vertically by a vertical movement, and are rotated together by rotation of the transport platform.

According to a second preferred embodiment, the transport surfaces are vertically displaceable independently of one another by means of individual lifts, wherein the individual lifts are provided on a common rotary table which rotates about the central axis.

A further preferred embodiment of the invention is characterized in that a pulling apparatus operating in a radial direction is provided on each of the transport surfaces, for pulling a vehicle out of an entrance or out of a parking compartment onto the transport surface, and for pushing a vehicle from the transport surface into an exit or into a parking compartment. The pulling apparatus moves the vehicle being parked by using the wheels of the vehicle.

The apparatus of the aforementioned '182 patent utilizes a pushing and pulling apparatus comprising a sliding carriage movable radially of the transport surfaces along a radial guide rail. The carriage includes a pair of arms having rollers thereon adapted to engage the front wheels of a vehicle and to pull the vehicle by its front wheels out of the parking compartment or entrance and onto the adjacent transport surface. During the reverse process of expelling the vehicle, the sliding carriage pushes the vehicle by its front wheels.

Inasmuch as many vehicle owners prefer to leave their car in "park" and locked, it is deemed preferable to provide a transfer apparatus for moving vehicles onto, and off of, transport surfaces without the need to require rolling of the wheels of the vehicle.

Further, the apparatus of the '182 patent requires rotational movement of each transport surface having a vehicle thereon to align the vehicle with a selected parking compartment. Rotational movement of one transport surface requires rotational movement of the entire carousel, thereby generally mandating moving only one vehicle at a time into a parking compartment.

It is deemed preferable to have the facility of moving a plurality of vehicles into parking compartments at substantially the same time.

OBJECT OF THE INVENTION

Accordingly, it is an object of the invention to provide an automatic parking garage wherein vehicles having wheels in a non-rotatable condition may be transferred from and onto a transport surface.

A further object of the invention is to provide an automatic parking garage in which each transport surface is adapted to service a plurality of storage bays without rotative movement of the carousel to precisely align the transport surface with the selected storage bay.

More generally, a still further object is to provide an improved apparatus for conveying items to a selected receiving station.

SUMMARY OF THE INVENTION

With the above and other objects in view, as will hereinafter appear, a feature of the present invention is the provision of an apparatus for conveying items to a selected receiving station, the apparatus comprising a round carousel rotatable about a center thereof to align a portion thereof with a selected azimuth, a vertically movable platform disposed in the carousel, the platform being movable rotatably with the carousel and movable vertically in the carousel to a selected height, and a sled disposed on the platform and movable on the platform sidewise through a path concentric with the carousel to align the sled with a second selected azimuth, the sled being configured to receive thereon at least one of the items. The item is movable circularly by the carousel, vertically by the platform, and circularly by the sled, whereby to be conveyed to and from the receiving station disposed at the selected height, at the selected azimuth.

In accordance with a further feature of the present invention, there is provided a parking garage comprising a storage housing having a plurality of floors arranged in vertical order, the housing being of a configuration defining an annulus, and each of the floors having a plurality of radially-oriented parking bays open inwardly of the annulus. A carousel is disposed centrally of the housing and adjacent thereto. A plurality of discrete, vertically-movable platforms are disposed in the carousel, each of the platforms being movable to a selected one of the housing floors, and the carousel being rotatable to align the carousel platforms each with a selected group of the parking bays in the selected floor of the storage housing. A sled is disposed on each of the platforms and is movable on the platform sidewise through a path concentric with a juncture of the annulus and the carousel so as to align the sled with a selected one of the group of parking bays, the sled being configured to receive thereon a vehicle for transport to the selected parking bay by one or more of (i) rotating the carousel, (ii) vertically moving the platform on which the vehicle in disposed, and (iii) moving the sled on which the vehicle is disposed.

In accordance with a still further feature of the present invention, there is provided a parking garage comprising a storage housing having a plurality of floors arranged in vertical order, the housing being of a configuration defining an annulus, and each of the floors having a plurality of radially-oriented parking bays open inwardly of the annulus. A carousel is disposed centrally of the housing and is adjacent thereto. An integral platform is vertically movable in the carousel. A plurality of sleds is each movable in its own region of the platform concentric with a juncture of the annulus and the carousel so as to align the sled with a selected one of the parking bays, the sled being configured to receive thereon a vehicle for transport to the selected parking bay by one or more of (i) rotating the carousel, and (ii) moving the sled on which the vehicle is disposed.

BRIEF DESCRIPTION OF THE DRAWINGS

The above and other objects and features of the present invention will be more fully disclosed or rendered obvious by the following detailed description of the preferred embodiments of the invention, which are to be considered together with the accompanying drawings wherein like numbers refer to like parts, and further wherein.

DETAILED DESCRIPTION OF THE PREFERRED EMBODIMENTS

Figure 1:
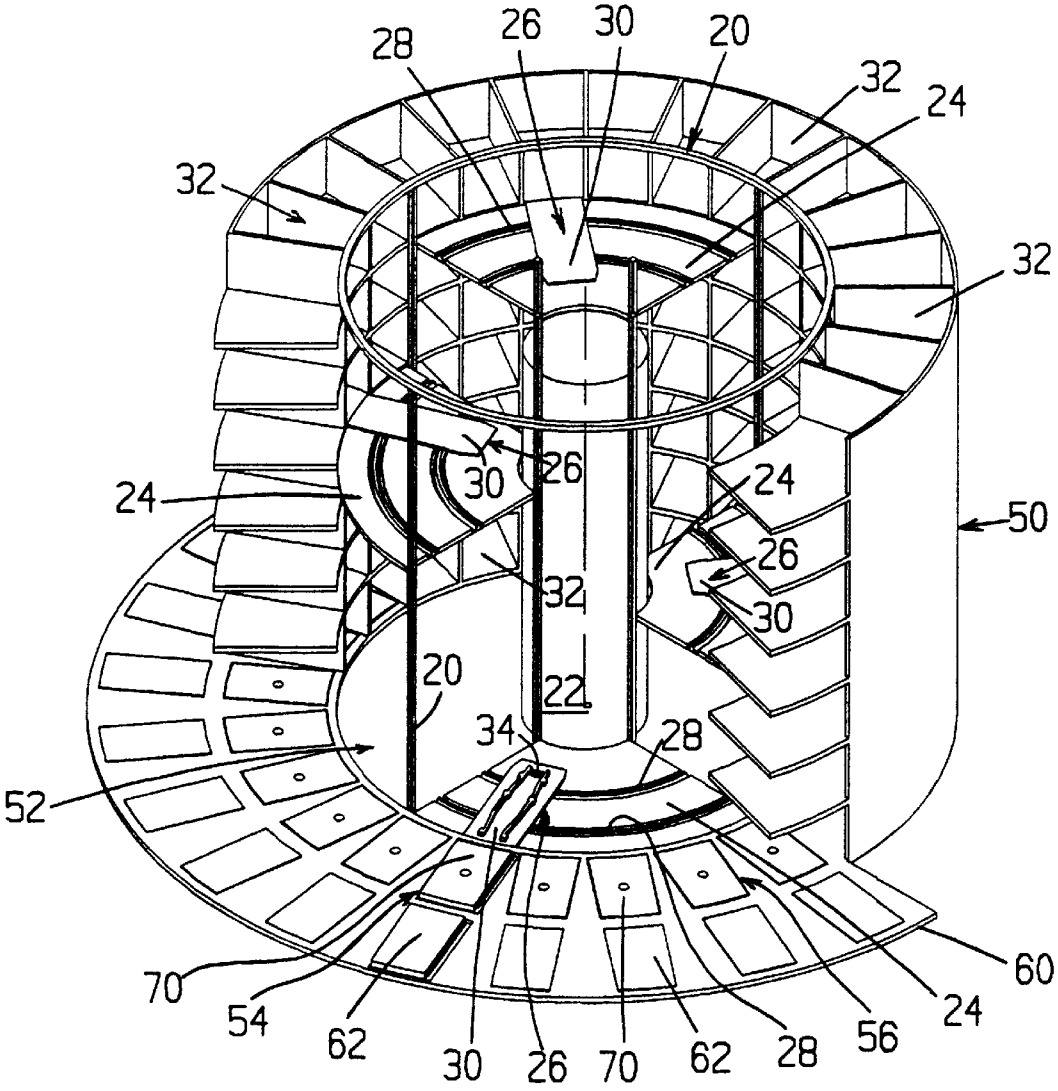
FIG. 1 is a diagrammatic perspective view, broken away, of one form of parking garage formed in accordance with the present invention, wherein the parking garage comprises a center carousel having a plurality of discrete vertically movable platforms thereon, and further wherein each of the platforms includes a sled movable on that platform so as to be selectively alignable with each of the parking spaces outlying the current position of that platform.
Figure 2:
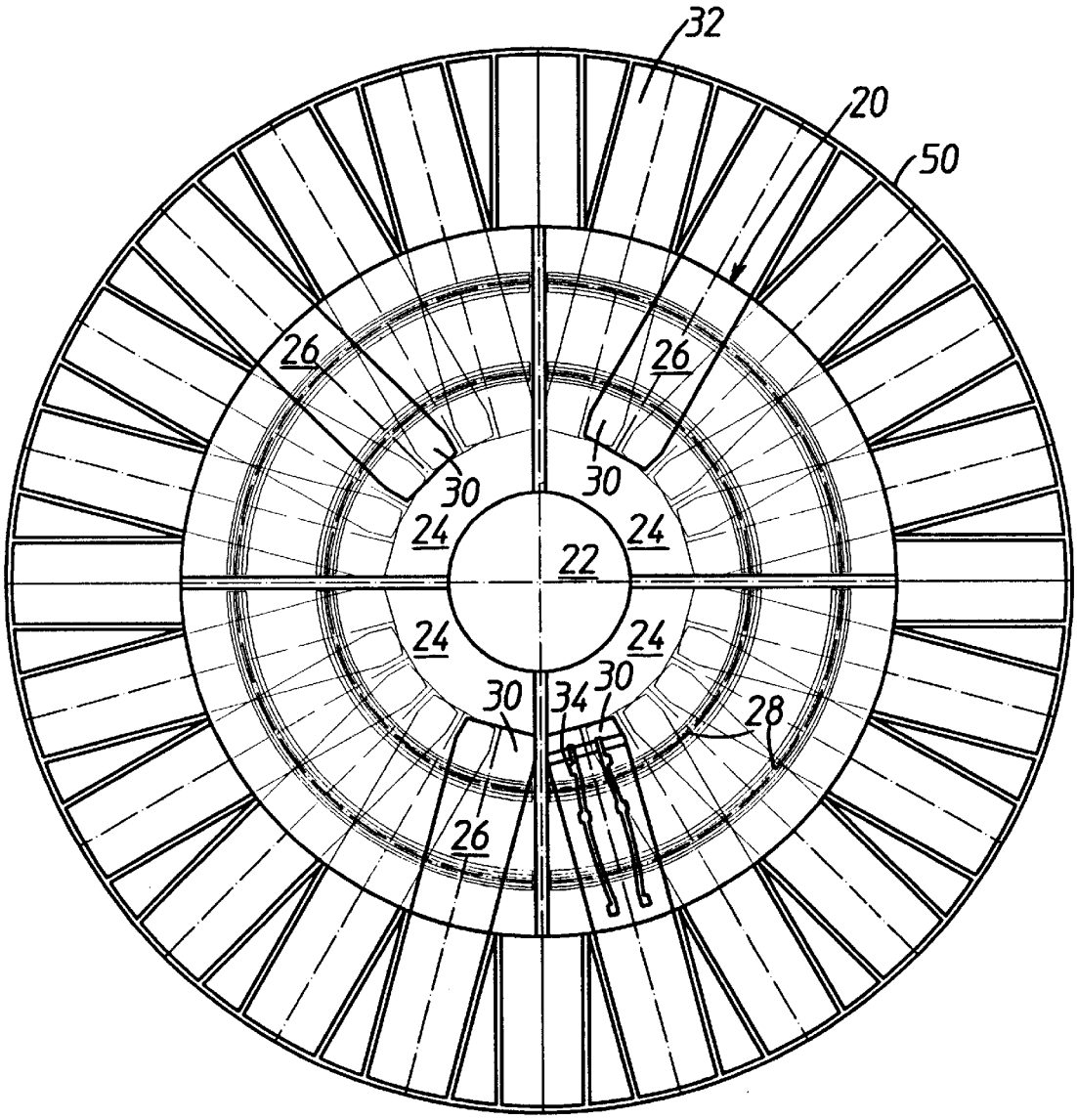
FIG. 2 is a diagrammatic top plan view of the parking garage shown in FIG. 1.

Referring first to FIG. 1, it will be seen that an illustrative apparatus includes a round carousel 20 rotatable about a central cylindrically-shaped core 22. If desired, core 22 may be a post, either solid or hollow. More preferably, however, core 22 may be a substantially hollow space, so as to reduce the weight of carousel 20. Carousel 20 is adapted to be driven in a circular fashion about the central axis of core 22. For example, where core 22 is a post, carousel 20 may be rotated by rotating the post. Alternatively, where core 22 is a hollow space, carousel 20 may be rotated by engaging other portions of the carousel. At least one vertically movable platform 24 is disposed in carousel 20 and is movable rotatably with carousel 20, and is movable vertically in carousel 20 to a selected height.

A sled 26 is disposed on each platform 24 and is movable on platform 24 sidewise through a path defined by tracks 28 concentric with carousel central core 22 so as to align sled 26 with a selected azimuth. The sleds 26 each are provided with an upper surface 30 for receiving a vehicle or other item (not shown) thereon.

Thus, the vehicle or item disposed on surface 30 of sled 26 is movable circularly by carousel 20, vertically by platform 24, and circularly by sled 26, so as to be conveyed to and from a selected storage bay 32 disposed at the aforesaid selected height and at the aforesaid azimuth.

Figure 3:
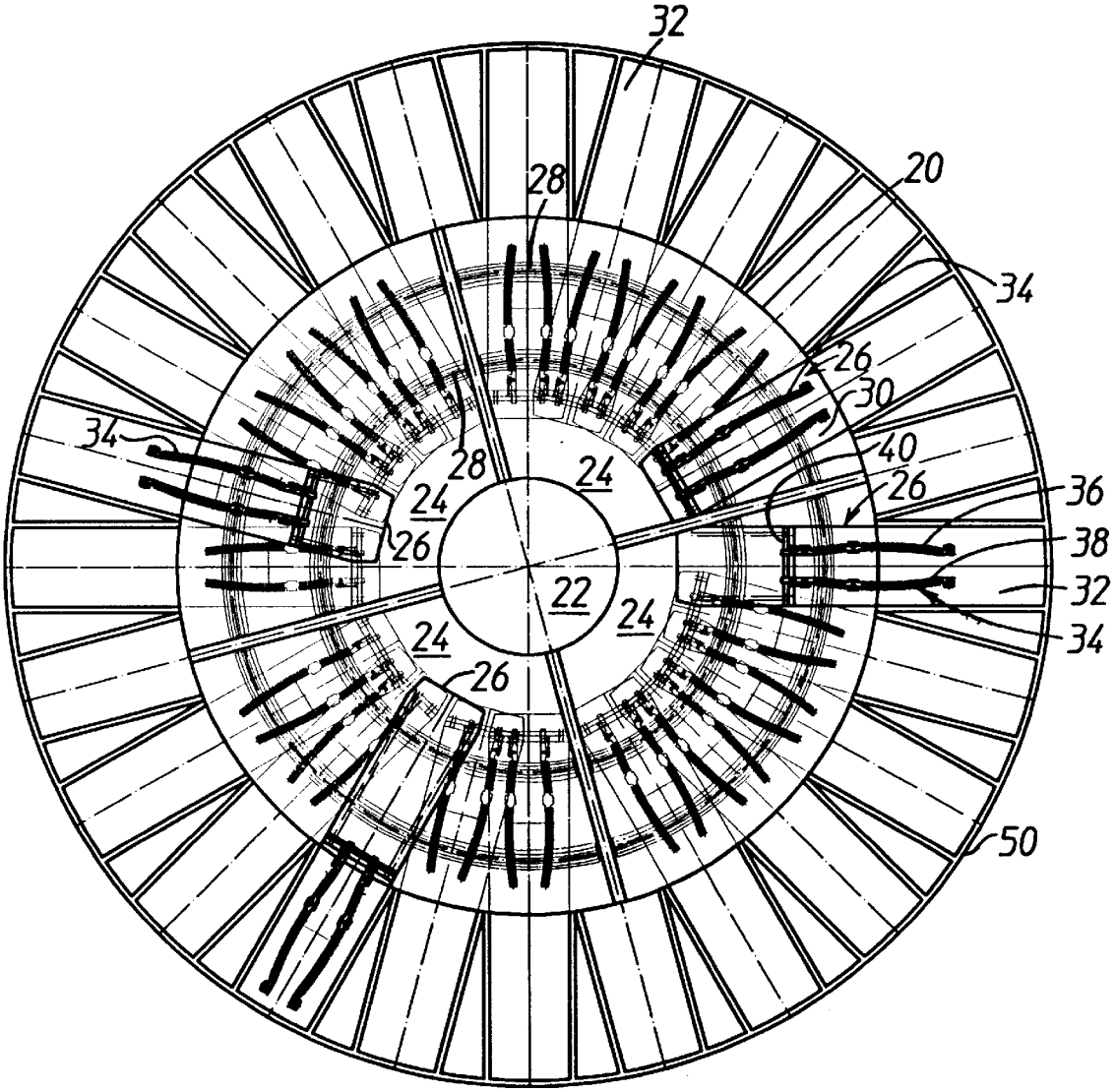
FIG. 3 is a top plan view showing one possible form of conveying apparatus for moving vehicles onto, and off of, the sleds disposed on the vertically movable platforms.
Figure 10:
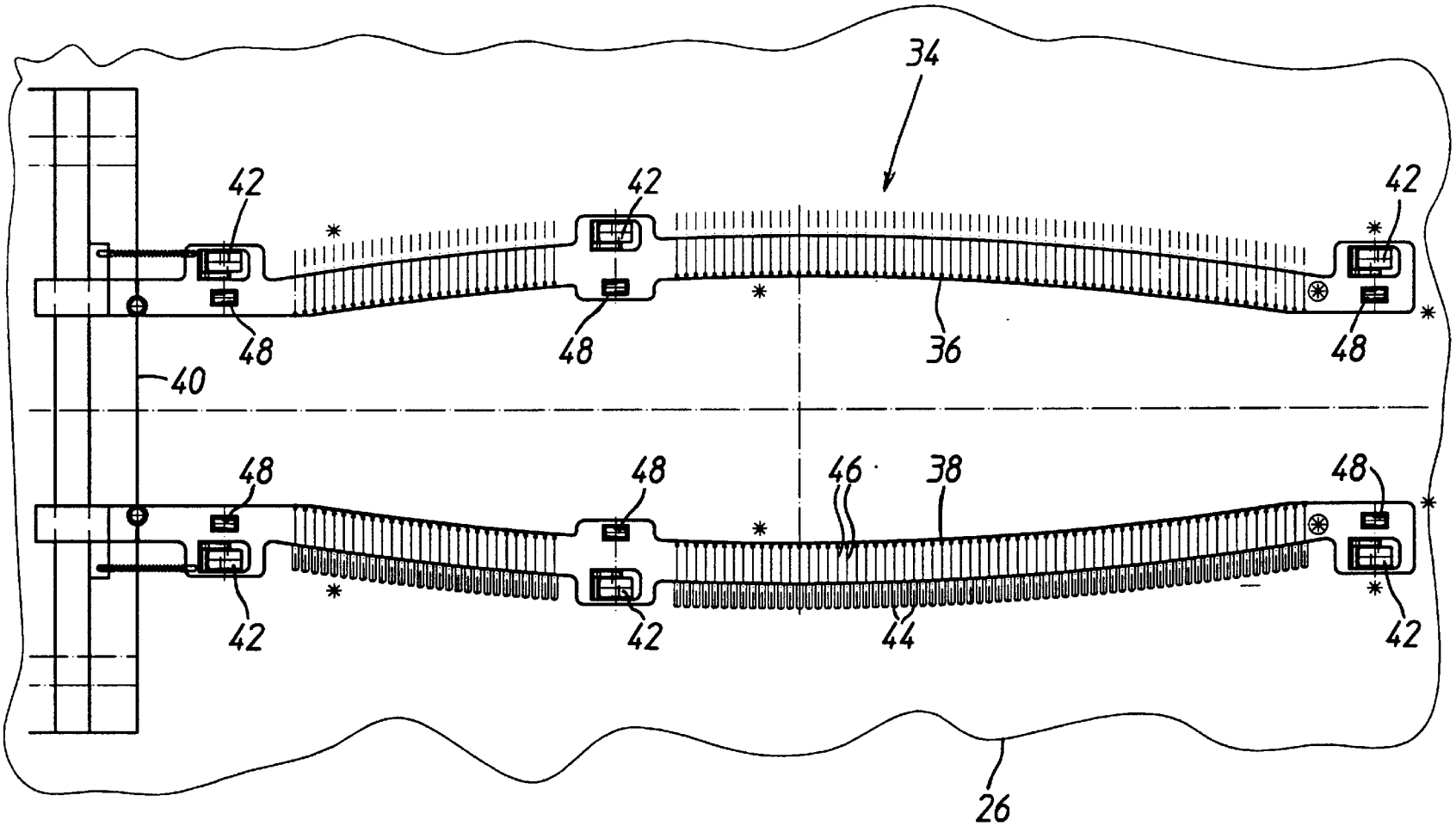
FIG. 10 is a top plan view of one form of conveying means disposed on each of the sleds for conveying a vehicle onto and off of the sled.
Figure 11:
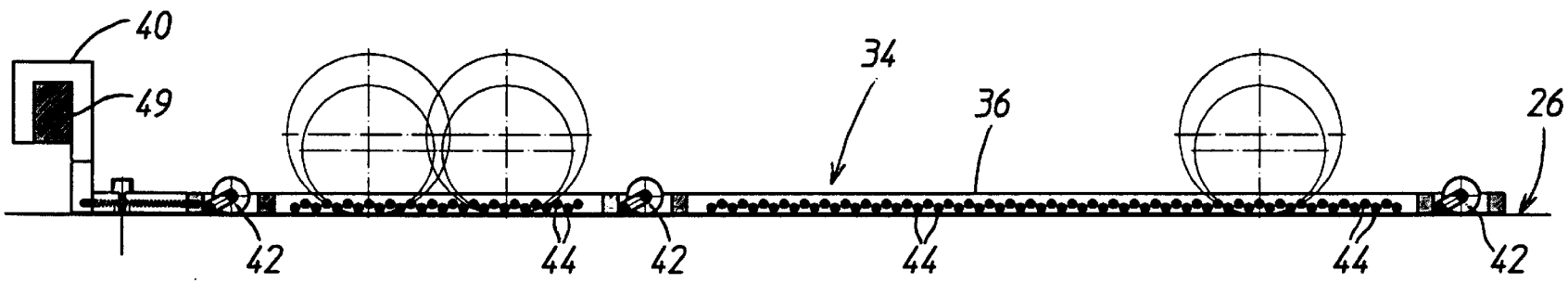
FIG. 11 is a side diagrammatic view of the conveying means of FIG. 10 in a first position.

On each sled 26, there is disposed a conveying means 34 (FIGS. 3 and 10–12) including a pair of arms 36, 38 extending from a base member 40 and supported by rollers 42 and 48 (FIG. 10). Each arm 36, 38 is provided with outwardly-directed and biased pins 44, each of which is adapted to move inwardly under pressure into a cylinder 46 against the outwardly-directed bias. As will be further described herein below, when a vehicle is disposed at a drop-off location, arms 36, 38 are adapted to move beneath the vehicle on rollers 42, rollers 42 are then retracted up into arms 36, 38 so that arms 36, 38 rest on rollers 48, and then the arms 36, 38 are rolled laterally away from one another on rollers 48, such that applicable pins 44 engage the wheels of the vehicle, including inside, back and front portions of the wheels (FIG. 11). Alternatively, the arms 36, 38 can be adapted to be initially disposed on either side of the vehicle and having pins directed, and biased, inwardly (not shown). In such case, the arms 36, 38 are moved inwardly toward each other on rollers 48 so as to engage the vehicle wheels from the outer sides of the wheels, rather than the inner sides of the wheels when the arms 36, 38 are disposed beneath the vehicle. After engaging the tires of the vehicle, or other item on the sled 26, the conveying means 34 are caused by an actuator 49 (FIGS. 11 and 12) to rise from the upper surface 30 of the sled 26 (FIG. 11) to a slightly raised position on the rollers 42 (FIG. 12), thereby lifting the vehicle or other item on sled 26. Conveying means 34 are then moved lengthwise of the sled 26 and radially outwardly of the carousel 20, as shown in FIG. 3, so as to carry the vehicle, or other item, into a selected one of the storage bays 32. Once the vehicle is disposed in the storage bay 32, the conveying means 34 is lowered to the surface of the storage bay 32 so that arms 36, 38 again rest on rollers 48, the arms 36, 38 are moved laterally on rollers 48 so as to disengage from the tires of the vehicle, the arms 36, 38 are then again lifted on rollers 42. The arms 36, 38 are next moved longitudinally on rollers 42 so as to withdraw arms 36, 38 from beneath the vehicle, and the conveying means 34 is returned to its sled 26. It should be appreciated that conveying means 34 are adapted to convey a vehicle from one location to another while the wheels of that vehicle are in either a non-rotatable (i.e., locked) condition, or in a rotatable condition, as the case may be. This feature is significant, as it permits the vehicle to be moved about the storage facility regardless of whether the driver has left the vehicle in "park" or "gear" or "neutral", and regardless of whether the parking break has been set.

Figure 12:
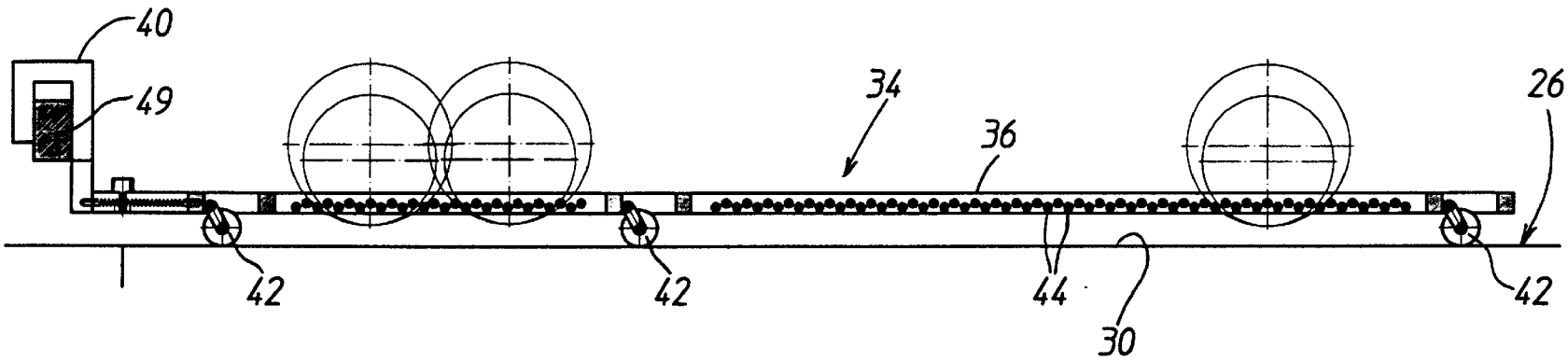
FIG. 12 is similar to FIG. 11, but showing the conveying means in a second position.
Figure 13:
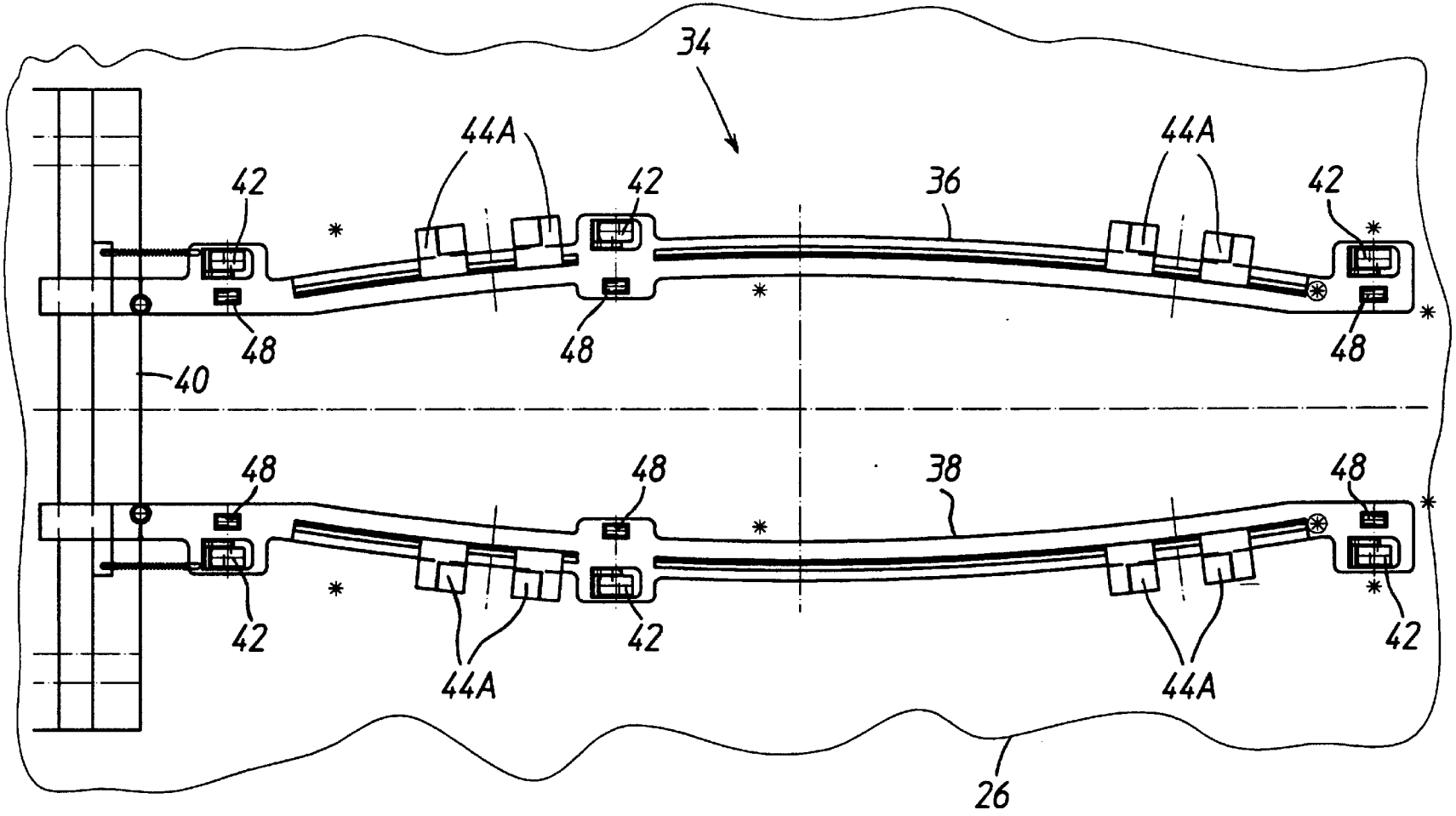
FIG. 13 is a top plan diagrammatic view of an alternative form of conveying means for conveying a vehicle onto and off of the sled.

An alternative form of conveying means 34 is shown in FIG. 13. The conveying means 34 shown in FIG. 13 is similar to the conveying means 34 shown in FIGS. 10–12, except that the biased pins 44 of FIGS. 10–12 are replaced by a plurality of supports 44A. Supports 44A are adapted to slide along arms 36, 38. With this construction, when a vehicle is disposed at a drop-off location, arms 36, 38 are initially supported on rollers 42, with supports 44A in a spaced-apart condition on arms 36, 38, and the arms 36, 38 are slid under the vehicle on rollers 42. Then arms 36, 38 are lowered onto rollers 48 and moved laterally until a support 44A is disposed in front of, and in back of, each tire of the vehicle. Then the supports 44A are moved towards the tires, so that one support 44A engages the front of each tire and one support engages the rear of each tire. Then arms 36, 38 are raised up on rollers 42, thereby raising the vehicle on supports 44A, and the vehicle is carried from the drop-off location onto sled 26. Subsequently, arms 36, 38 (carrying the vehicle) are rolled (on rollers 42) off sled 26 into a storage bay, arms 36, 38 are lowered onto rollers 48, supports 44A are moved along arms 36, 38 away from the vehicle's tires, and arms 36, 38 are moved laterally on rollers 48. Then arms 36, 38 are raised back up on rollers 42, and finally arms 36, 38 are withdrawn from beneath the vehicle. As with the conveying means 34 of FIGS. 10–12, the conveying means 34 of FIG. 13 can be constructed so as to be inserted under the vehicle between the vehicle's tires, in which case supports 44A extend outboard of arms 36, 38 in the manner shown in FIG. 13, or the conveying apparatus of FIG. 13 can be configured so as to approach the vehicle from outboard of the vehicle, in which case supports 44A extend inboard of arms 36, 38 (not shown). Again, it is to be appreciated that the conveying means 34 shown in FIG. 13 are adapted to convey a vehicle from one location to another while the wheels of that vehicle are in either a non-rotatable (i.e., locked) condition, or a rotatable condition, as the case may be.

Figure 14:
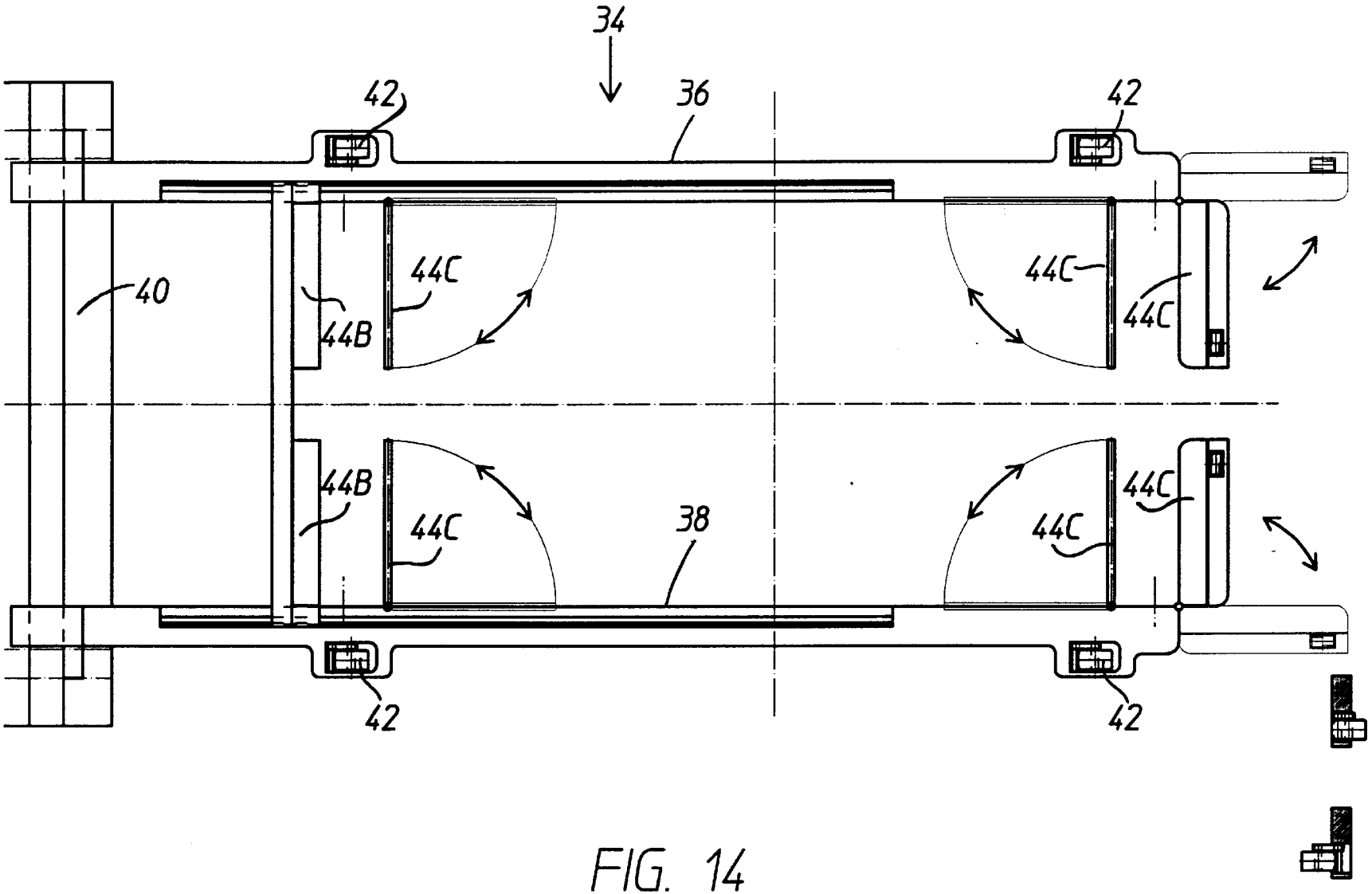
FIG. 14 is a top plan diagrammatic view of still another alternative form of conveying means for conveying a vehicle onto and off of the sled.
Figure 16:
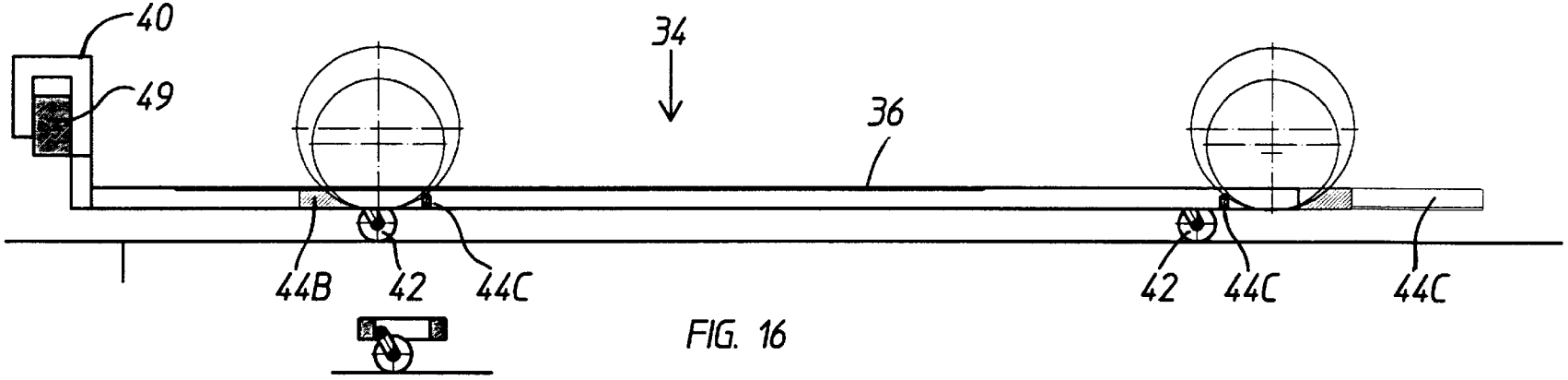
FIG. 16 is similar to FIG. 15, but showing the conveying means in a second position.
Figure 15:
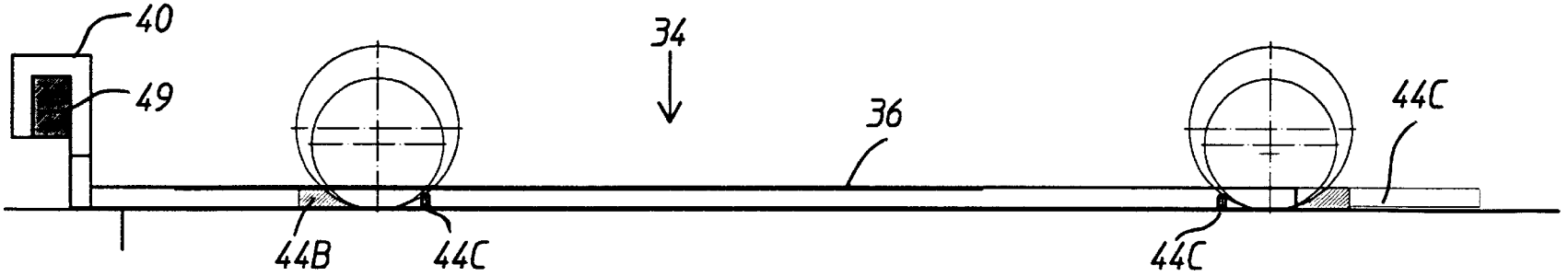
FIG. 15 is a side diagrammatic view of the conveying means of FIG. 14 in a first position.

Still another alternative form of conveying means 34 is shown in FIGS. 14–16. The conveying means 34 shown in FIGS. 14–16 is similar to the conveying means 34 shown in FIGS. 10–12, except that the biased pins 44 of FIGS. 10–12 are replaced by a plurality of supports 44B, 44C. Supports 44B are adapted to slide along arms 36, 38, and supports 44C are adapted to pivot on arms 36, 38. With this construction, when a vehicle is disposed at a drop-off location, arms 36, 38 are initially supported on rollers 42, with supports 44C folded inwardly so that they reside parallel to arms 36, 38. Arms 36, 38 are slid on either side of the vehicle on rollers 42 until supports 44B engage the front two tires of the vehicle. Then the supports 44C are pivoted towards the tires, so that one support 44B engages the front of each front tire and one support 44C engages the rear of each front tire, and so that one support 44C engage the front of each rear tire and one support 44C engages the rear of each rear tire. Then arms 36, 38 are raised further up on rollers 42, thereby raising the vehicle off the ground, and the vehicle is carried from the drop-off location onto sled 26. Subsequently, arms 36, 38 (carrying the vehicle) are rolled (on rollers 42) off sled 26 into a storage bay, arms 36, 38 are lowered somewhat on rollers 42 so as to allow the vehicle's tires to re-contact the ground, and supports 44C are pivoted on arms 36, 38 away from the vehicle's tires. Then arms 36, 38 (riding on rollers 42) are withdrawn from beneath the vehicle. Again, it is to be appreciated that the conveying means 34 shown in FIGS. 14–16 are adapted to convey a vehicle from one location to another while the wheels of that vehicle are in either a non-rotatable (i.e., locked) condition, or a rotatable condition, as the case may be.

Adjacent the carousel 20 is an annularly-shaped housing 50 (FIG. 1) having a number of floors arranged in vertical order and in which the storage bays 32 are arranged in radial alignment with platforms 24. As shown in FIG. 1, a plurality of bays 32 are in alignment with a given platform 24 (six bays 32 shown in FIG. 1 are aligned with a given platform 24).

The carousel 20 is provided with an entry and exit level or levels 52, there being shown in FIG. 1 a single level 52 for both entry and exit of vehicles. The housing 50 is provided with at least one entry bay 54 (FIG. 1) on a level with the carousel entry level and at least one exit bay 56 on a level with the carousel exit level.

Figure 4:
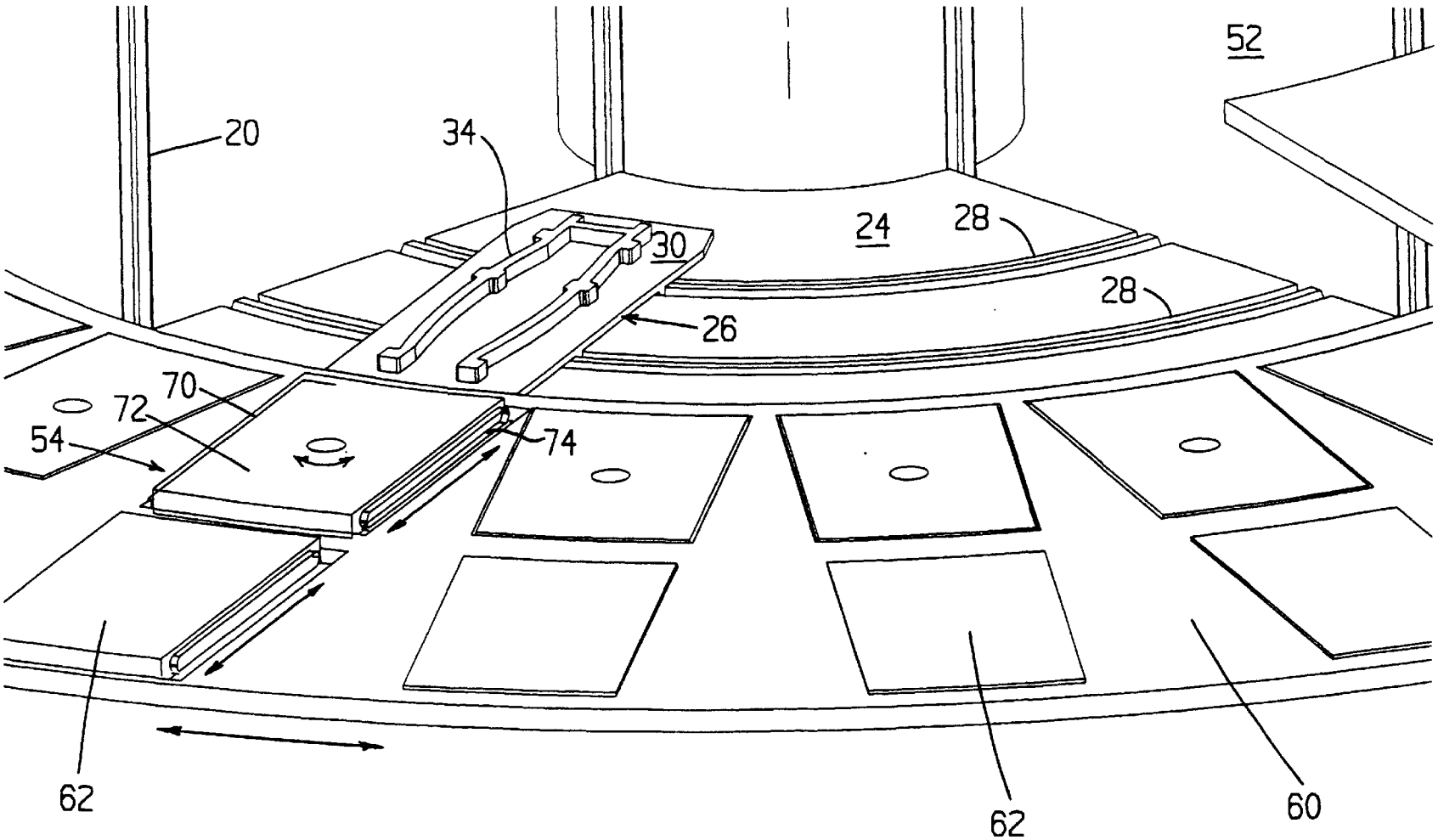
FIG. 4 is an enlarged view showing one possible construction for vehicle orienting apparatus disposed at the carousel's loading/unloading bays and adapted to change the orientation of the vehicles either before they are picked up by the sled or after they are dropped off by the sled.

An annular conveyor 60 is preferably disposed around the housing 50 (FIGS. 1 and 4) on the level of the housing entry bay 54 and exit bay 56. The conveyor 60 is rotatable around the housing 50 and is provided with pads 62, each of which is adapted to receive a vehicle and is alignable with the housing entry bay 54 and exit bay 56. The conveyor 60 delivers vehicles, or other items, from the entry and exit bays 54, 56 to drop-off and pick-up locations.

The entry and exit bays 54, 56 preferably are each provided with an apparatus 70 (FIGS. 1 and 4) for orienting vehicles or other objects. The orienting apparatus 70 preferably is rotatable 180 degrees so as to change the direction of a vehicle thereon. When the apparatus herein described is used for the storage of vehicles, it is advantageous to utilize the orienting apparatus 70 to change the orientation of vehicles before the vehicles are picked up by sleds 26 or after the vehicles are dropped off by sleds 26. In a preferred embodiment of the invention, the vehicle will generally be driven into the automatic garage front end first, and will generally be stored in a storage bay back end first, in which case orienting apparatus 70 is adapted to change the orientation of the vehicle after the vehicles are dropped off by sleds 26, as the vehicle exits the garage. Preferably the orienting apparatus 70 comprises a conveyor belt 72 (FIG. 4) mounted on a platform 74 which is rotatable through 180 degrees.

Figure 5:
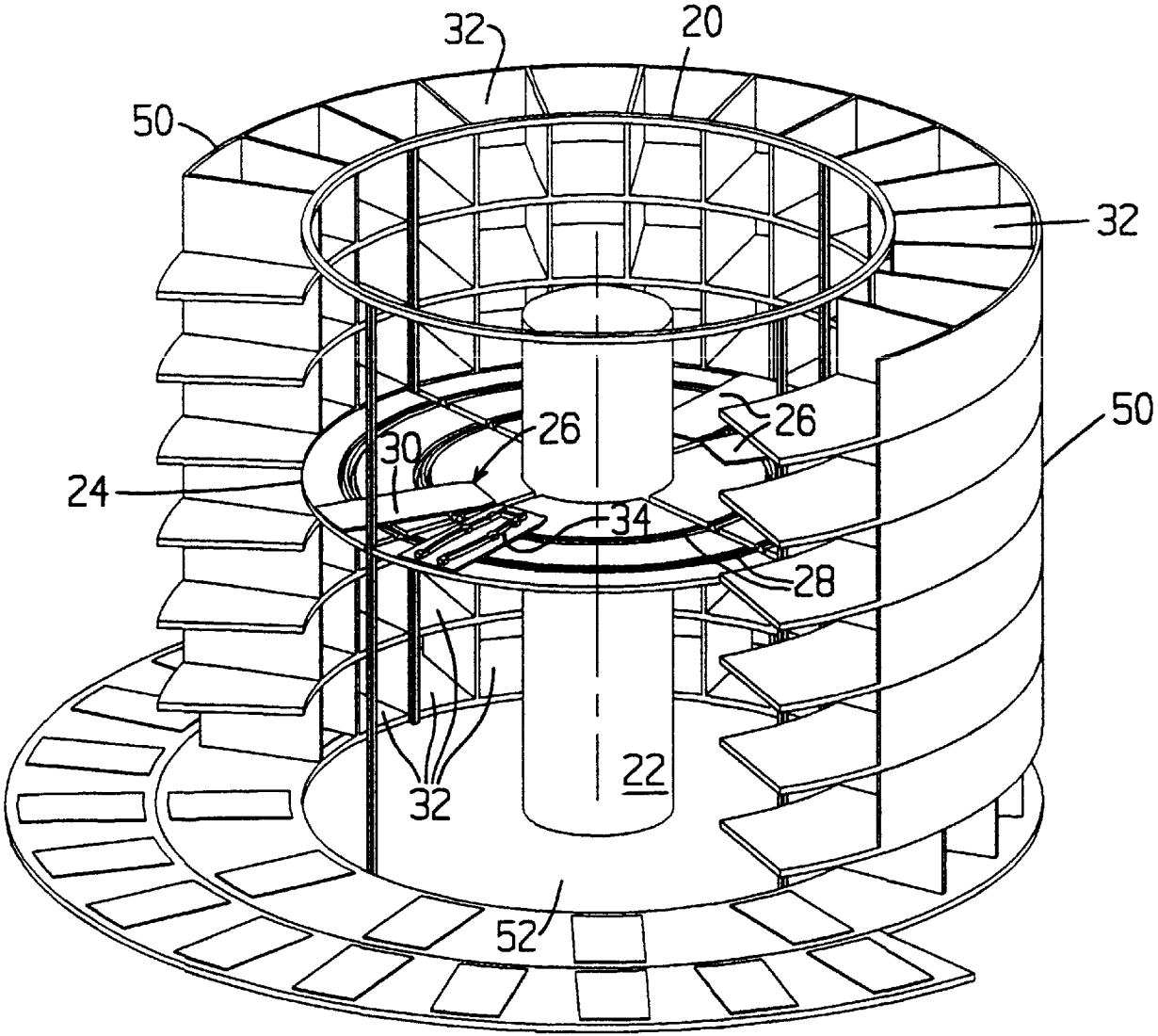
FIG. 5 is a diagrammatic perspective view, broken away, of a second form of parking garage formed in accordance with the present invention, wherein the parking garage comprises a center carousel having a integral platter vertically movable thereon, and further wherein the platter supports a plurality of sleds each movable on its own region of the platter so as to be selectively alignable with each of the parking spaces outlying that region of the platter.

The carousel 20 preferably has mounted therein a number of discrete platforms 24, as shown in FIG. 1, the platforms 24 being vertically movable individually, and each platform 24 having at least one sled 26 movably mounted thereon. In an alternative embodiment, a single platform 24 (FIG. 5) is provided, the entire platform being raised and lowered as a single integral unit. In this construction, platform 24 has at least one, and preferably a plurality of, sleds 26 movably mounted thereon.

In an alternative embodiment, shown in FIGS. 6–9, there is added to a core portion, substantially as described hereinabove, additional vertically movable platforms 80, each comprising a portion of an annulus, and each having a sled 82 movable sidewise in an arcuate fashion along tracks 84. The sleds 82 are each provided with conveying means 34, as shown in conjunction with sleds 26 in FIGS. 1–5 and 10–16.

Figure 6:
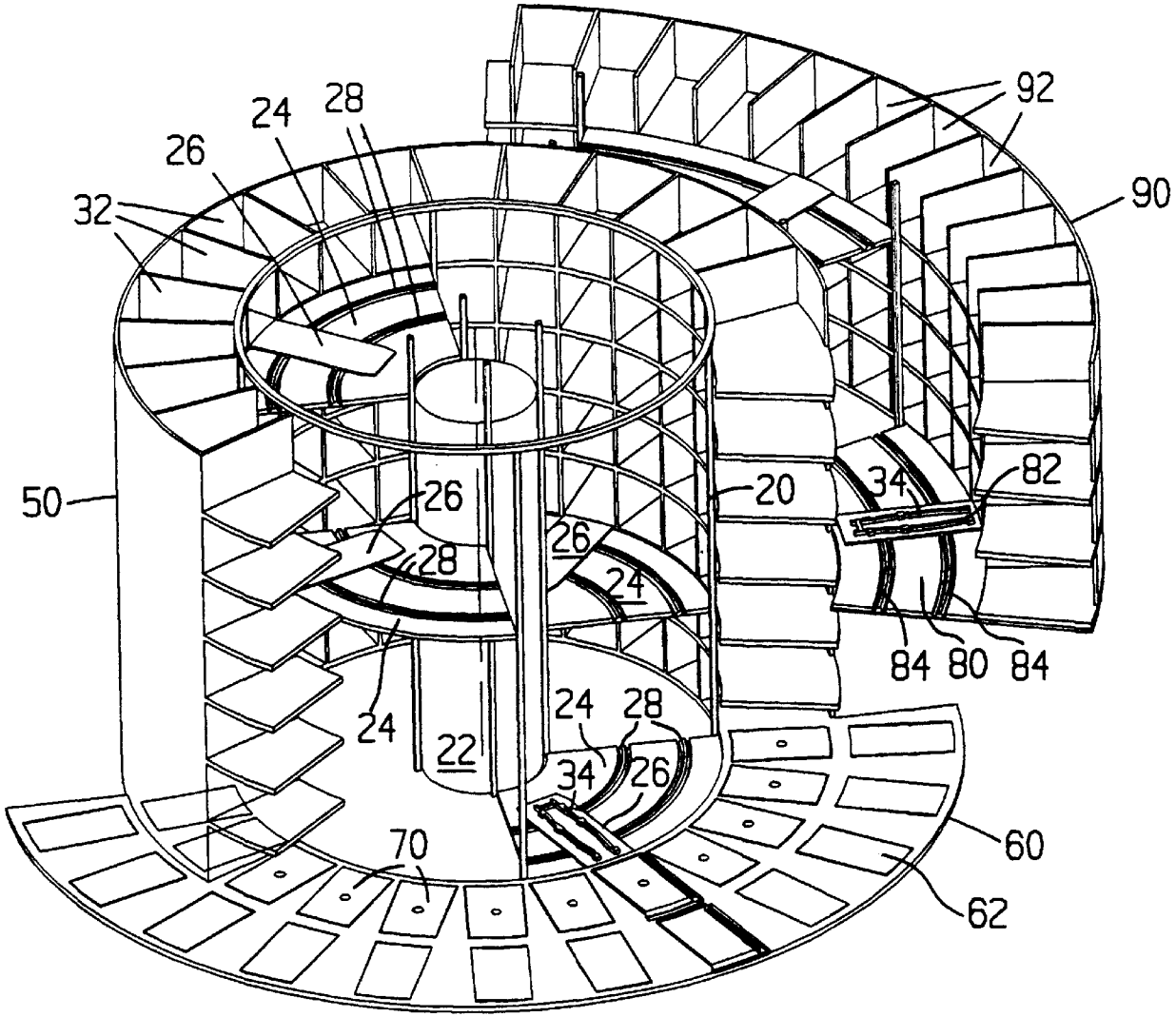
FIG. 6 is similar to FIG. 1, but illustrative of an alternative embodiment of parking garage.
Figure 7:
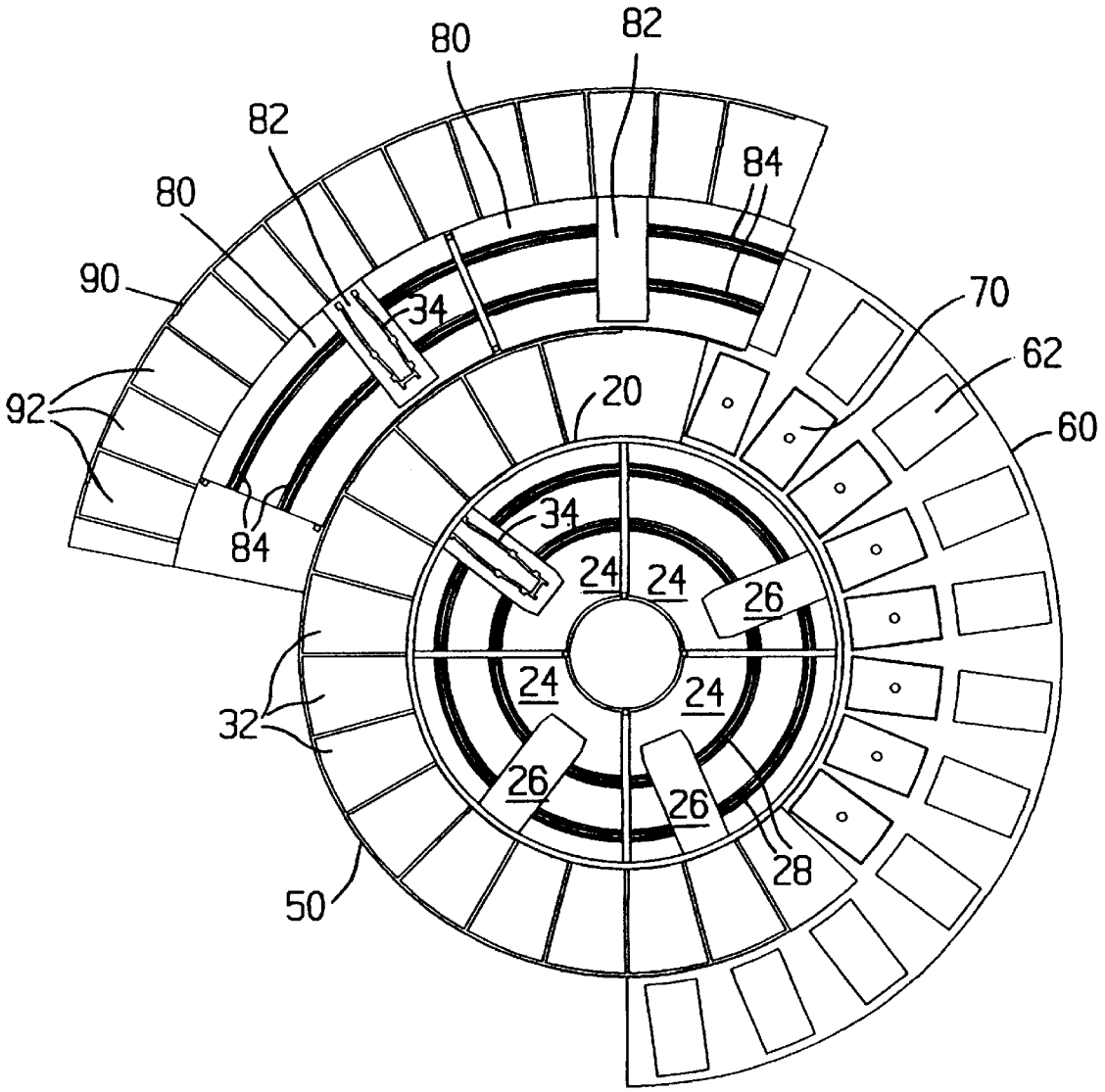
FIG. 7 is a top plan view of an entry and/or exit level of the parking garage of FIG. 6.
Figure 8:
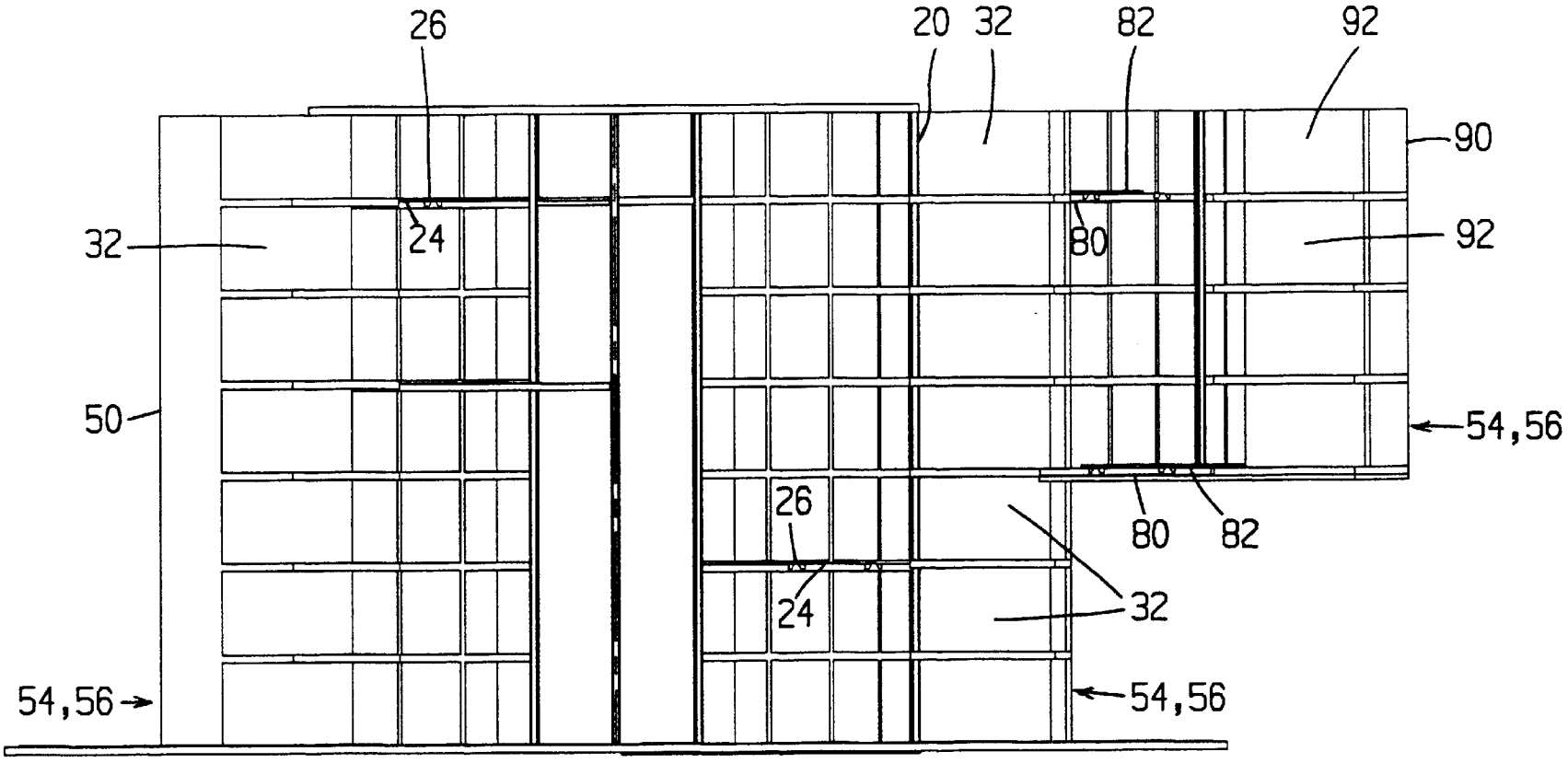
FIG. 8 is a side elevational view of the parking garage of FIG. 6.
Figure 9:
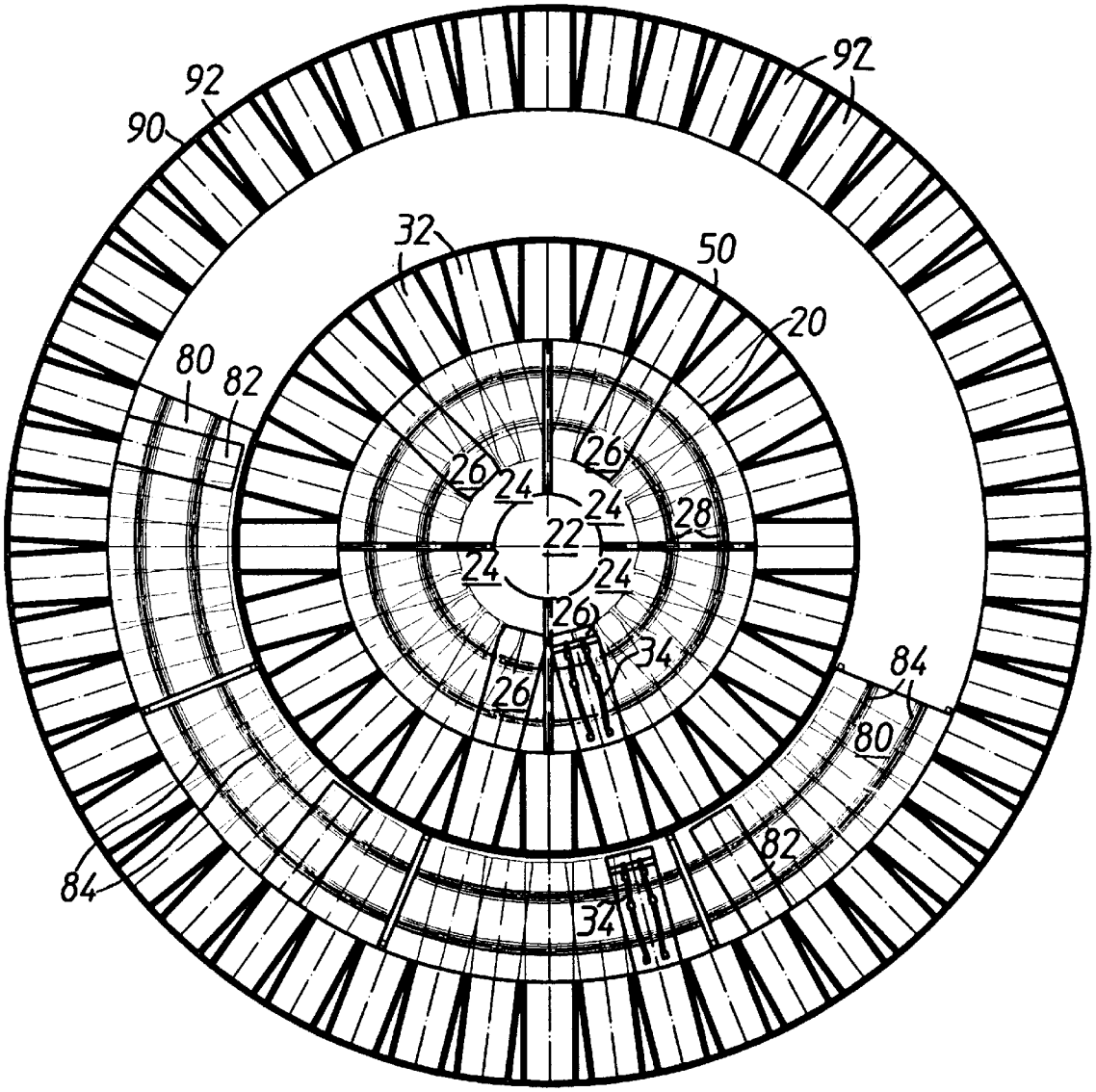
FIG. 9 is a top plan view of the parking garage of FIG. 6.

Radially outwardly from platforms 80, and adjacent thereto, is an outer housing 90 having storage bays 92 therein in radial arrangement. The sleds 82 are each alignable with a bay 92. The outer housing 90 may extend completely around the inner core (FIG. 9), or outer housing 90 may extend only partially around the inner core (FIGS. 6 and 7). Further, the platforms 80 and outer housing 90 may be of a different height than carousel 20 and housing 50, as shown in FIG. 8, to conform to underlying topography. In such a case, the apparatus can be provided with different carousel entry and exit levels and corresponding different levels for housing entry and exit bays 54, 56.

In operation, an item is placed on a pad 62 (FIG. 1) of conveyor 60. When the apparatus is used for the storage of vehicles, a vehicle (not shown) is driven onto pad 62 and left in a locked condition by the vehicle operator. The conveyor 60 is indexed around one place to bring one of the pads 62 into alignment with an entry bay 54 in which there is disposed an orienting apparatus 70. The pad 62 comprises a conveyor (FIG. 4) movable radially of the carousel and this conveyor operates to move the vehicle front wheels, which are not in turnable condition, onto orienting apparatus 70. Apparatus 70 is also a conveyor movable radially of the carousel and the conveyor of apparatus 70 operates, in conjunction with pad 62, to move the vehicle onto apparatus 70. If it is desired at this point to re-orient the vehicle, so as to turn the vehicle so that it is directed outwardly rather than inwardly, orienting apparatus 70 is rotated 180 degrees. Preferably, however, as noted above, the vehicle will generally be re-oriented as it is removed from the storage system.

The conveying means 34 on a sled 26 aligned with apparatus 70 is then actuated to reach onto apparatus 70 and engage and lift the vehicle and draw the vehicle onto sled 26, and then to lower the vehicle onto upper surface 30 of sled 26.

The platform 24, on which the vehicle-carrying sled 26 is mounted, rises in carousel 20 to the appropriate level. The carousel 20 rotates around central core 22 to bring platform 24 into radial alignment with a sector of the selected level having, among its storage bays 32, at least one empty bay. The sled 26 on which the vehicle is mounted moves (if necessary to align with an empty bay) sidewise on tracks 28 to align with the empty bay 32. The conveying means 34 then raises the vehicle off the surface 30 of sled 26 and moves axially of sled 26 and radially outwardly from carousel 20, to move the vehicle into the storage bay 32. Once the vehicle is in bay 32, the conveying means 34 lowers the vehicle onto the surface of bay 32 and disengages from the vehicle and returns to its sled 26. The platform 24 then travels to the next position or location for admission of another vehicle.

It will be appreciated that rotation of carousel 20, vertical movement of platform 24, and movement of sled 26 along tracks 84 may take place in a serial fashion or, more preferably, may take place in a sometimes simultaneous fashion, so as to optimize operation of the storage facility. Furthermore, it will be appreciated that various platforms 24, and various sleds 26, will typically all be moving in various independent fashions about the carousel, even as the carousel may be stationary or moving, so as to optimize operation of the storage facility.

Furthermore, in view of the flexibility of operation afforded by virtue of the fact that sleds 26 are movable independently of carousel 20, carousel 20 may be adapted for substantially continuous movement during operation of the storage apparatus, with sleds 26 operated so as to initiate and maintain alignment with the desired entry bay 54, storage bay 32 and/or exit bay 56, as appropriate. In other words, the carousel would continue to turn even as a vehicle is moved onto and off of a sled, with the sled moving laterally as needed so as to maintain the desired orientation of the vehicle during the loading or unloading operation. Thus, there is no need to start and stop carousel 20 to assure proper alignment of a vehicle with a given entry bay 54, storage bay 32 and/or exit bay 56. This is very beneficial, given the effort and time required to start and stop an object having the mass of carousel 20, and provides a significant advantage over the prior art.

To retrieve the vehicle, the sequence of operation is essentially reversed, except that orienting apparatus 70 is caused to turn 180 degrees only once in the admission and discharge of a vehicle. Thus, in leaving the apparatus, if the vehicle had already been turned 180 degrees, it would not be turned again, but would be moved from the platform 24 to the orienting apparatus 70 and then directly onto conveyor 60. However, as noted above, it is generally preferred that the vehicle be turned as it is leaving the storage apparatus.

Furthermore, it should also be appreciated that conveyor apparatus 60 might, in some circumstances, be omitted, in which case the driver of the vehicle might enter the vehicle while it is still disposed on orienting apparatus 70.

The sequence of steps in the parking and discharge of a vehicle, or other item, is preferably governed by a computer which keeps track of the locations of all the above described components of the assembly, and of which storage bays are occupied and which are not. Alternatively, the assembly may be operated partially by manual controls, but to accept and discharge the largest member of vehicles in the shortest time, it is preferred that the entire operation be computerized, such that in a few minutes prior to a sports or theater event, or the like, a large number of vehicles arriving more or less simultaneously may be quickly parked or, at the conclusion of the event, a large number of vehicles may be quickly delivered to their waiting drivers.

It will be apparent that the alternative embodiment of FIGS. 6–9 requires additional orienting apparatus 70 (not shown) suitable for additional entry and exit bays for the outer housing 90, and preferably additional conveyor means 60. However, the operation of the outer platform 80 and associated devices is essentially the same as described hereinabove with respect to housing 50.

It should also be appreciated that, if desired, one or more storage bays 32 could be configured as a car washing station. With such an arrangement, a vehicle might initially be placed in one storage bay 32, thereafter transferred to a car washing storage bay 32 for cleaning, and then returned to the original, or possibly to a different, storage bay for storage until the driver's return.

There in thus provided an assembly for absorbing and discharging a large number of vehicles very quickly, and in which a vehicle operator may lock the vehicle and carry away the keys thereto.

It is to be understood that the present invention is by no means limited to the particular construction herein disclosed and/or shown in the drawings, but also comprises any modifications or equivalents within the scope of the claims.

What is claimed is:

1. Apparatus for conveying items to a selected receiving station, said apparatus comprising:

a round carousel rotatable about a center thereof to align a portion thereof with a selected azimuth;

a vertically movable platform disposed in said carousel, said platform being movable rotatably with said carousel and movable vertically in said carousel to a selected height; and a sled disposed on said platform and movable on said platform sidewise through a path concentric with said carousel to align said sled with a second selected azimuth, said sled being configured to receive thereon at least one of said items;

wherein said item is movable circularly by said carousel, vertically by said platform, and circularly by said sled, whereby to be conveyed to and from the receiving station disposed at said selected height, at said second azimuth;

wherein said apparatus is adapted to convey items to and from the receiving station while said carousel is moving.

2. Apparatus according to claim 1 and further comprising conveying means on said sled for conveying at least one of said items onto, and off of, said sled.

3. Apparatus according to claim 2 wherein said conveying means on said sled is movable lengthwise of said sled and radially inwardly and outwardly of said carousel.

4. Apparatus according to claim 2 wherein said carousel is provided with an entry and exit level, and said apparatus includes a housing adjacent said carousel and having entry and exit bays therein for loading the items onto, and off of, said sled.

5. Apparatus according to claim 4 wherein said housing further comprises a conveyor on said entry and exit levels for transporting the items to and from, respectively, said entry and exit bays.

6. Apparatus according to claim 4 wherein said housing further comprises an annular conveyor for delivering the items to and from said entry and exit bays from drop-off and pick-up locations adjacent said housing.

7. Apparatus according to claim 1 wherein said carousel comprises a hollow core.

8. Apparatus according to claim 1 wherein said apparatus is adapted to move said sled as needed to maintain a desired orientation relative to said receiving station as said items are conveyed to and from the receiving station.

9. A parking garage comprising:

a storage housing comprising a plurality of floors arranged in vertical order, said housing being of a configuration defining an annulus, and each of said floors having a plurality of radially-oriented parking bays open inwardly of said annulus;

a carousel disposed centrally of said housing and adjacent thereto;

a plurality of discrete vertically-movable platforms disposed in said carousel, each of said platforms being movable to a selected one of said housing floors, and said carousel being rotatable to align said carousel platforms each with a selected group of said parking bays on said selected floor of said storage housing; and a sled disposed on each of said platforms and movable on said platform sidewise through a path concentric with a juncture of said annulus and said carousel so as to align said sled with a selected parking bay in said group of parking bays, said sled being configured to receive thereon a vehicle for transport to said selected parking bay by one or more of (i) rotating said carousel, (ii) vertically moving the platform on which said vehicle is disposed, and (iii) moving the sled on which said vehicle is disposed;

wherein said parking garage is adapted to convey a vehicle to and from the parking bay while said carousel is moving.

10. A parking garage according to claim 9 wherein said parking garage further comprises conveying means on each said sled for conveying a vehicle onto, and off of, said sled.

11. A parking garage according to claim 10 wherein said conveying means is movable lengthwise of each said sled and radially toward and away from said storage housing.

12. A parking garage according to claim 10 wherein said storage housing includes, on entry and exit levels thereof, entry and exit bays for loading vehicles onto, and off of, each said sled.

13. A parking garage according to claim 12 wherein said parking garage further comprises a conveyor on said entry and exit levels for transporting vehicles to and from, respectively, said entry and exit bays.

14. A parking garage according to claim 12 wherein vehicle orienting apparatus is disposed adjacent to said entry and exit bays for changing the orientation of the vehicles a selected one of: (i) before they are picked up by said sled, and (ii) after they are dropped off by said sled.

15. A parking garage according to claim 14 wherein said vehicle orienting apparatus is rotatable 180 degrees so as to change the direction of vehicles disposed thereon.

16. A parking garage according to claim 15 wherein said vehicle orienting apparatus comprises a conveyor belt which is mounted on a platform which is rotatable 180 degrees.

17. A parking garage according to claim 12 wherein said parking garage further comprises a conveyor for delivering vehicles to said entry and exit bays from vehicle drop-off and pick-up location.

18. A parking garage according to claim 9 and further comprising:

an outer housing comprising an outer plurality of floors arranged in vertical order, said outer housing being of a configuration defining an outer annulus, each of said outer plurality of floors having a plurality of radially-oriented outer parking bays open inwardly of said outer annulus;

a plurality of discrete vertically-movable second platforms disposed between said storage housing and said outer housing, each of said second platforms being movable to a selected one of said outer housing floors; and a second sled disposed on each of said second platforms and movable on said second platform sidewise through a second path concentric with a juncture of said outer housing and said second platforms so as to align said second sled with a selected outer parking bay, said second sled being configured to receive thereon a second vehicle for transport to said selected outer parking bay.

19. Apparatus according to claim 9 wherein at least one of said parking bays comprises car wash apparatus.

20. A parking garage according to claim 9 wherein said parking garage is adapted to move said sled as needed to maintain a desired orientation relative to said parking bay as the vehicle is conveyed to and from the parking bay.

21. A parking garage comprising:

a storage housing comprising a plurality of floors arranged in vertical order, said housing being of a configuration defining an annulus, and each of said floors having a plurality of radially-oriented parking bays open inwardly of said annulus;

a carousel disposed centrally of said housing and adjacent thereto;

an integral platform vertically movable in said carousel; and a plurality of sleds each movable in a region of said platform sidewise along a path concentric with a juncture of said annulus and said carousel so as to align said sled with a selected parking bay, said sled being configured to receive thereon a vehicle for transport to said selected parking bay by one or more of (i) rotating said carousel, and (ii) moving the sled on which said vehicle is disposed;

wherein said parking garage is adapted to transport a vehicle to the parking bay while said carousel is moving.

22. A parking garage according to claim 21 wherein said parking garage further comprises conveying means on each of said sleds for conveying a vehicle onto, and off of, said sled.

23. A parking garage according to claim 22 wherein said conveying means is movable lengthwise of said sleds and radially toward and away from said storage housing.

24. A parking garage according to claim 22 wherein said housing includes, on entry and exit levels thereof, entry and exit bays for loading vehicles onto, and off of, said sleds.

25. A parking garage according to claim 24 wherein said parking garage further comprises conveyors on said entry and exit levels for transporting vehicles to and from, respectively, said entry and exit bays.

26. A parking garage according to claim 24 wherein vehicle orienting apparatus is disposed adjacent to said entry and exit bays for changing the orientation of the vehicles a selected one of: (1) before the vehicles are picked up by said sleds, and (2) after the vehicles are dropped off by said sleds.

27. A parking garage according to claim 26 wherein said vehicle orienting apparatus is rotatable 180 degrees so as to change the direction of vehicles disposed thereon.

28. A parking garage according to claim 27 wherein said vehicle orienting apparatus comprises a conveyor belt which is mounted on a platform which is rotatable 180 degrees.

29. A parking garage according to claim 24 wherein said parking garage further comprises a conveyor for delivering vehicles to said entry and exit bays from vehicle drop-off and pick-up locations.

30. A parking garage according to claim 21 wherein said parking garage is adapted to move said sled as needed to maintain a desired orientation relative to said parking bay as said vehicle is transported to the parking bay.

31. A method for storing and retrieving objects, said method comprising:

(1) providing apparatus for conveying items to a selected receiving station, said apparatus comprising:

a round carousel rotatable about a center thereof to align a portion thereof with a selected azimuth;

a vertically movable platform disposed in said carousel, said platform being movable rotatably with said carousel and movable vertically in said carousel to a selected height; and a sled disposed on said platform and movable on said platform sidewise through a path concentric with said carousel to align said sled with a second selected azimuth, said sled being configured to receive thereon at least one of said items;

wherein said item is movable circularly by said carousel, vertically by said platform, and circularly by said sled, whereby to be conveyed to and from the receiving station disposed at said selected height, at said second azimuth;

(2) mounting said item on said sled;

(3) moving said apparatus so as to align said item with a selected receiving station;

(4) dismounting the item from said sled at the selected receiving station;

(5) remounting said item on said sled;

(6) moving said apparatus so as to align said item with another location; and (7) dismounting the item from said sled;

wherein said carousel continues to rotate as the item is mounted on, or dismounted from, said sled.

32. A method according to claim 31 wherein said sled moves as needed to maintain a desired orientation relative to said receiving station as the item is mounted on, or dismounted from, said sled.

33. A method for storing and retrieving vehicles, said method comprising:

(1) providing a parking garage comprising:

a storage housing comprising a plurality of floors arranged in vertical order, said housing being of a configuration defining an annulus, and each of said floors having a plurality of radially-oriented parking bays open inwardly of said annulus;

a carousel disposed centrally of said housing and adjacent thereto;

a plurality of discrete vertically-movable platforms disposed in said carousel, each of said platforms being movable to a selected one of said housing floors, and said carousel being rotatable to align said carousel platforms each with a selected group of said parking bays on said selected floor of said storage housing; and a sled disposed on each of said platforms and movable on said platform sidewise through a path concentric with a juncture of said annulus and said carousel so as to align said sled with a selected parking bay in said group of parking bays, said sled being configured to receive thereon a vehicle for transport to said selected parking bay by one or more of (i) rotating said carousel, (ii) vertically moving the platform on which said vehicle is disposed, and (iii) moving the sled on which said vehicle is disposed;

(2) mounting a vehicle on said sled;

(3) moving said sled so as to align said vehicle with a selected receiving station;

(4) dismounting the vehicle from said sled at the selected receiving station;

(5) remounting said vehicle on said sled;

(6) moving said sled so as to align said vehicle with another location; and (7) dismounting the vehicle from said sled;

wherein said carousel rotates as the vehicle is dismounted from said sled.

34. A method according to claim 33 wherein said sled moves as needed to maintain a desired orientation relative to said parking bay as the vehicle is dismounted from said sled.

35. A method for storing and retrieving vehicles, said method comprising:

(1) providing a parking garage comprising:

a storage housing comprising a plurality of floors arranged in vertical order, said housing being of a configuration defining an annulus, and each of said floors having a plurality of radially-oriented parking bays open inwardly of said annulus;

a carousel disposed centrally of said housing and adjacent thereto;

an integral platform vertically movable in said carousel; and a plurality of sleds each movable in a region of said platform sidewise along a path concentric with a juncture of said annulus and said carousel so as to align one of said sleds with a selected parking bay, each of said sleds being configured to receive thereon a vehicle for transport to said selected parking bay by one or more of (i) rotating said carousel, and (ii) moving said one of said sleds on which said vehicle is disposed;

(2) mounting said vehicle on said one of said sleds;

(3) operating said parking garage so as to align said vehicle with a selected receiving station;

(4) dismounting the vehicle from said one of said sleds at the selected receiving station;

(5) remounting said vehicle on said one of said sleds;

(6) operating said parking garage so as to align said vehicle with another location; and (7) dismounting the vehicle from said one of said sleds;

wherein said carousel rotates as the vehicle is dismounted from said one of said sleds.

36. A method according to claim 35 wherein said one of said sleds moves as needed to maintain a desired orientation relative to said parking bay as the vehicle is dismounted from said one of said sleds.

* * * * *